US006212925B1

(12) United States Patent
Wang et al.

(10) Patent No.: US 6,212,925 B1
(45) Date of Patent: Apr. 10, 2001

(54) METHOD FOR ROLL FORMING STEEL PIPES, AND EQUIPMENT FOR SAME

(75) Inventors: Feizhou Wang, Nishinomiya; Atsumu Okamoto, Kawanishi, both of (JP)

(73) Assignee: Nakata Manufacturing Co., Ltd., Osaka (JP)

( * ) Notice: Subject to any disclaimer, the term of this patent is extended or adjusted under 35 U.S.C. 154(b) by 0 days.

(21) Appl. No.: 09/296,411

(22) Filed: Apr. 23, 1999

(51) Int. Cl.[7] ..... B21D 39/02; B21D 51/28
(52) U.S. Cl. ..... 72/52
(58) Field of Search ..... 72/51, 52, 181, 72/182, 178, 179, 176

(56) References Cited

U.S. PATENT DOCUMENTS 5,301,869 * 4/1994 Toyooka et al. ..... 72/52

FOREIGN PATENT DOCUMENTS 61-1423 * 1/1986 (JP) ..... 72/52
3-230817 * 10/1991 (JP) ..... 72/52
404178221 * 6/1992 (JP) ..... 72/52

* cited by examiner

*Primary Examiner*—Rodney A. Butler
(74) *Attorney, Agent, or Firm*—Arent Fox Kintner Plotkin & Kahn, PLLC

(57) ABSTRACT

It is an object of the present invention to provide a novel roll-forming method for steel pipes and equipment for same with which (1) the evidence that forming work in the FF forming method is mainly carried out at the cluster forming portion showing the poor formability is modified and improved without any deteriorating the advantage of the common-utilization of rolls in the FF forming method which employs basically the circular-bend method, and (2) the forming function at the breakdown forming portion is enhanced. Accordingly, the pinch-point formed by the upper and lower rolls is set at a boundary area between the target forming zone in the material's width direction and previously-formed zone or un-formed zone. The target forming zone is wound around a certain caliber of the upper roll on the bend-inner side, and bend-formed in such a way that the target forming zone is almost in non-contact with the lower roll as a result, the formability is remarkably improved and occurrences of roll flaws and roll marks or buckling can be prevented.

7 Claims, 11 Drawing Sheets

METHOD FOR ROLL FORMING STEEL PIPES, AND EQUIPMENT FOR SAME

BACKGROUND OF THE INVENTION

1. Field of the Invention

The present invention relates to a roll forming method for welded steel pipes; with said method the common-utilization of rolls can be realized regardless of the wide variation in dimensions of materials to be formed. The present invention, more specially, relates directly to a novel roll forming method for welded steel pipes by setting the pinch-point (which is a specified location for holding the material to be formed with upper and lower rolls) at the boundary area between the target forming zone and formed or unformed zone along the width direction of the material, and by making said target forming zone in contact with the pre-determined caliber of the upper roll which is placed on the bend-inner side but not making the bend-outer side of the target forming zone in contact with the lower roll to perform the bend forming process, so that the bend-formability can be remarkably improved, roll-flows or roll-scratches can be avoided, and accordingly the common-utilization of rolls can be realized at the break-down forming portion for the edge-bend method.

2. Description of the Prior Arts

In the forming of welded steel pipes, a required cross sectional profile will be made by bending the band steel subsequently in the material's width direction using forming rolls. At the breakdown forming portion which indicates the early stage of roll-forming process, the material to be formed (which is the band steel plate) is, in advance, formed into a semi-circular shape. The thus pre-formed material is then processed through the cluster forming and the fin-pass portion, where the material is formed into an open-shape circular cross-sectional profile.

At the aforementioned breakdown forming portion, mainly two types of forming methods are employed such as the roll-flowers as seen in FIG. 1. With the edge-bend method, the material to be formed is divided into several portions along the width direction and is formed portion by portion to approach the final circular shape. (In the followings, the bend-inner side is referred to the position above the steel plate; while the bend-outer side is referred to the position below the steel plate.) On the other hand, in the circular-bend method, the curvature of the total width of the material is increased stepwise.

By either methods just described in the above, one pair of upper and lower contour rolls is normally used in the conventional breakdown forming stand, as seen in FIG. 2A. For example, the pair of rolls is consisted of a lower roll 2 with concave roll surface(caliber) and an upper roll 3 with convex caliber. The target forming zone of the material 1 to be formed(in other words, both sides of bend-inner and bend-outer sides of the material) is pressed in the pre-set roll gap.

By such conventional forming methods, it is required to pre-set the uniform roll-gap which is equivalent to the wall thickness of the band steel plate in order to provide the pre-determined radius of curvature to the material(which is the band steel plate). However, this forming method possesses following practical drawbacks.

Since there is an unavoidable variation in the plate thickness, and moreover the material during the deformation is also subjected to the variation in thickness, even if the uniform roll gaps being equivalent to the plate thickness are pre-set, the roll surface and the band steel plate surface will not be perfectly in contact. They will rather be in contact in a discontinuous manner. Furthermore, the contacting zone as well as the contacting forces changes with time, and it is impossible to predict these variations.

As a result of the aforementioned technical problems associated with the conventional type of bending methods, it is difficult to set the reference diameter of the roll (which is a diameter corresponding to the roll surface portion having an equivalent rotational speed to moving speed of the material in the longitudinal direction). Consequently, it is very difficult to synchronize the rotational speeds of rolls among each stand, and there could be more loss in driving forces as well as their energies. Also, the surface of the final roll-formed product will suffer from the surface scratches and flaws. Furthermore, since the forming load and driving force are asymmetric along the width direction of the material, the band steel plate is apt to twist in the forming process.

Because both lower and upper rolls are used to form a desired roll gap, there is no flexibility to accommodate to the steel pipe forming with various sizes. For example, when either outer diameter or the wall thickness of the product changes, with the edge-bend method, all forming rolls are required to be exchanged. On the other hand, by the circular-bend method, if the outer diameter of the products remains the same value, rolls can be common-employed in forming pipes with various wall thickness (if they are within a certain limit) by adjusting the roll-gaps.

As a result, the circular-bend method is considered to be more practical than the edge-bend method. However, at the time of forming the material with relatively thin wall thickness, the roll-gaps will become to be uneven and constraint on the material is not sufficient, so that the expected formability can not be achieved. In other words, such common-utilizing of rolls might sacrifice the resultant formability.

However, in order to solve the technical problems of the operational performance and productivity associated with the exchanging operation of rolls, technologies have been developed with regard to the common-utilization of rolls. One of the typical example of such advanced methods is the so-called cage-forming mill.

With such type of mills, the common-utilization of rolls has been proposed by arranging a plurality of small-size rolls (cage rolls) instead of the conventional type of cluster rolls. At the breakdown forming portion, like as the case for the conventional type of mills, the common-utilization of rolls is not realized. In order to reduce the number of rolls which have to be exchanged, not only the forming load at the cluster forming portion but also a part of the forming load which is originally carried out at the breakdown forming portion are shifted to the cage-forming portion, so that the number of breakdown forming stands can be reduced.

However, the forming function of the cage rolls is extremely limited. Namely, since the contact area between the cage rolls and the material to be formed is very small, each cross-sectional portion of the material is formed under the non-uniform bending moment. The formability of such free-bending method depends strongly upon the size and material properties of the products. Accordingly, it is extremely difficult to obtain the desired curvature distribution as has been designed.

Particularly, there are many occasions when the over-bending phenomenon exhibits at the central portion of the steel plate, on which the largest bending moment usually acts. Even if the inner roll (which is the convex roll) is employed, it is impossible to make the bending moment uniform.

Because the excess forming work is allotted to the cage forming portion, adverse effects are influencing on the forming function and stability of the entire mill system. Accordingly, there are many problems recognized with these types of roll common-utilizing mill system.

In order to overcome the aforementioned drawbacks associated with the cage-type mill system, a roll-forming method has been proposed (which is, hereafter, referred as to an FF-flexible forming-method), see U.S. Pat. No. 4,770,019. By the FF forming method, the common-utilization of rolls can be realized not only at the cluster forming portion but also at the breakdown forming portion by using a special roll whose caliber is an involute (which changes its radius curvature either continuously or step-wisely) and employing a position-controlling mechanism for transferring and rotating such rolls.

In order to bend the edge portion of the material which is the most difficult portion to form, the roll arrangement as seen in FIG. 2B is normally used for the so-called No. 1 breakdown stand. According to the roll arrangement for the FF forming method, suitable involute curves are provided to the upper roll 3 (convex roll) and the lower roll 2 (concave roll) respectively, corresponding to the limits of inner and outer diameters of all products in concern.

Although the roll gaps formed with these rolls are normally not uniform, the upper and lower roll positions are determined in order to form the favorable roll-gaps at the edge portion of the material 1, corresponding to the size of the product to be formed. By employing this forming method, it is possible to perform edge-bending without any roll exchange, so that the overall mill formability is improved.

However, even with the FF forming method, the circular-bend type forming method is basically used to the stands except the No. 1 breakdown stand. As a result, most of the forming work is still carried out at the cluster forming portion.

SUMMARY OF THE INVENTION

As a consequence, in order to overcome the problems found in the above articles, it is, therefore, an object of the present invention to provide a novel roll forming method and equipment for same, with which, basically without deteriorating any advantages of the common-utilization of rolls in the FF forming method which uses the circular-bend method, the fact—that the forming work of the FF forming method is mainly located at the cluster forming portion showing the poor formability—can be modified, the formability can be enhanced at the breakdown forming portion, and the overall formability can be remarkably improved.

The present invention have proposed a novel forming method (Japan Patent Application Laid-Open No. Hei10-255319, PCT/JP98/04962) in which the edge-bend method is introduced to the FF forming method and a plurality of edge-bending stands is used at the breakdown forming portion in order to enhance the forming function and approximately half zone of the plate's width is formed portion by portion from its edge sides.

By the aforementioned method (which is now called FF/X forming method), the overall formability and stability of the mill system are improved. However, the bending method as seen in FIG. 2B of the FF forming method is conventionally used only for forming the material's edge portions and it is difficult to set the suitable roll-gaps for the case when the target forming zone is relatively wide.

Even with these advanced methods of FF or FF/X methods, the basic system concept is not different from the conventional one that the inner and outer surfaces of the material are sandwiched between a pair of concave and convex rolls and pressed in the roll gap. Moreover, this forming method has a technical concept such that although the target forming zone is not expected to be in contact with both concave and convex rolls since the involute calibers are used, the appropriate roll surface portions of convex and concave rolls are selected in order to bend the material in the roll gap into a shape similar to that of roll gap as possible.

The present inventors have conducted experiments and analyses to investigate the relationships between roll arrangement/orientation and forming functions in order to enhance the forming function at the breakdown forming portion while using effectively all advantages of FF, FF/X forming method which make it possible to common-utilize the rolls at the pipe mill system. As a result of extensive investigations, the present inventors have come to a conclusion that, in order to bend the material into a desired shape, it is not essentially necessary to employ a pair of concave and convex contour rolls.

Namely, the present inventors have found that, by winding a portion of the cross-section of the material to be formed (which is hereafter referred merely as to a target forming zone) around either an entire or a portion of the surface of the convex roll having a roll caliber with a certain curvature distribution, the almost same curvature distribution can be printed onto the target forming zone of the material without constraining the opposing surface by using the concave roll as been practiced conventionally. Here, this new bending method is named as 'embrace-bending'.

For example, the same forming can be achieved by employing the roll arrangement as seen in FIG. 3 instead of providing a pair of convex and concave rolls as seen in FIG. 2A. In the former case, the control of the curvature distribution is mainly conducted by the upper convex roll 12. Although a pair of left and right lower rolls is used, the principle function of these rolls is to provide a supporting force in order to wind the target forming zone around the convex roll surface 12, so that the embrace-bending can be performed. In other words, the target forming zone of the material can be controlled and supported in such a way that it can be in contact with the convex roll caliber portion whose curvature distribution is expected to be printed.

There are several important points associated with the aforementioned embrace-bending method. Firstly, the pinch-point serving a minimum distance between the convex and concave rolls is set at a certain location to control the position of material along the width direction. Secondly, the target forming zone of the material is wound around a caliber portion of the convex roll at the bend-inner side to print the expected curvature distribution to the target forming zone without constraining it from the bend outer side.

When the driving force is needed to be generated, the minimum distance between the convex and concave rolls at the pinch-point should be set to be equal to the wall thickness in order to obtain sufficient amount of pressure or frictional force. Both surfaces of the material are simultaneously constrained only at the pinch-point.

Normally, such a pinch-point is designed and set at the boundary area between the target forming zone and other portions of the material; which is, in turn, the portion being formed previously including the bending non-sensitive zone of the material's edge portion or un-formed portion of the material.

On the other hand, when the driving force is not required, it is not essential to constrain the inner and outer surfaces of the material simultaneously at the pinch-point. Instead, it is simply required to set the position for the concave roll in order to wind the target forming zone around the convex roll surface.

In summarizing the above, the present novel bending method is characterized by that (1) the zone along the width direction of the material to be formed at a certain stand is set as a target forming zone, (2) the pinch-point is set at the boundary between the target forming zone and other portions of the material in order to print the desired curvature distribution by winding the target forming zone around the surface of the convex roll mounted at the bend-inner side, and (3) the lower roll caliber is set in such a way that this roll will not contact the target forming zone from the bend-outer side as the conventional method does. (In other words, the target forming zone except the area at or near the pinch point is not constrained by the lower roll). Consequently, it is not necessary to provide the conventional type of roll caliber since the concave roll is not directly related to control the curvature distribution of the target forming zone.

According to the present novel roll-forming method, since the target forming zone of the material is basically constrained by only the convex roll, severe deformation hardly takes place. Moreover, occurrence of the excess deformation strain is controlled to the utmost, resulting in that steel pipes with excellent secondary-formability can be produced. This is the first advantage of the present novel roll-forming method.

Furthermore, when the rolls are driven, the roll diameter at the pinch-point can be considered as the reference roll diameter. Since the position of the pinch-point is very clearly identified and does not vary, it is very easy to synchronize the driving speeds among each stand. This is the second advantage of the present novel roll-forming method.

Moreover, even if the surface pressure at the pinch-point is varied within a certain limit due to the variation of the wall thickness, the symmetry with respect to left and right sides can be maintained, and twisting of the material is not caused because the contacting condition between the material and rolls is not altered. This can be considered as another advantage of the present novel roll-forming method.

As a result, it becomes to be possible to greatly improve the formability and stability of the mill system by introducing the embrace-bending concept of the present invention to the conventional breakdown forming portion. Moreover, according to the present invention, since it is not required that both concave and convex rolls have the exclusive calibers corresponding to the size of product to be formed, it is easily to perform the common-utilization of rolls. This should be the further advantage of the present novel roll-forming method.

According to the present novel roll-forming method for welded steel pipes, the whole area of the target forming zone along the width direction of the material is formed mainly by winding it around the surface of the convex roll located at the bend-inner side without constraining the target forming zone from the bend-outer side. Furthermore, the pinch-point formed by at least one pair of upper and lower rolls is positioned at the boundary area between the target forming zone and previously-formed material (which might include the bending non-sensitive zone of the material's edge portion) or unformed portion, so that the target forming zone can be bent along the roll surface at the bend-inner side without constraining the whole target forming zone from the bend-outer side.

BRIEF DESCRIPTION OF DRAWINGS

The above and many other objectives, features and advantages of the present invention will be fully understood from the ensuing detailed description of the embodiments of the present invention whose description should be read in conjunction with the accompanying drawings.

FIG. 5A shows a breakdown forming stand where the "embrace-bending" concept of the present invention is applied to welded steel pipe forming with common-utilizing of rolls; for the case of forming large diameter pipe, whereas

FIG. 11A shows a side view of the loci of the edge portion of the material at the breakdown forming portion while FIG. 11B shows an upper view when the pass-line is set in order to have the bottom of the roll flower to be a straight line and FIG. 11C shows a side view when the pass-line is arranged in order to have the edge locus to be a straight line.

DETAILED DESCRIPTION OF PREFERRED EMBODIMENTS

According to the present invention, the embrace-bending method is basically applicable to all types of forming mills and forming methods and it is possible to rationalize the existing forming processes. However, when it is employed as a portion of the common-utilization technology of rolls, the excellent function which can not be realized with the conventional forming methods can be recognized.

It is, especially, noticed that the present novel bending method is indispensable in order to establish the advanced common-utilization technology of rolls based on the edge-bend forming method having a strong forming function such as the aforementioned FF/X forming method. In the followings, the roll arrangements and roll forming method by which the "embrace-bending" concept as defined by the present inventors can be practiced and the common-utilization of rolls can be realized.

Figure 1A:
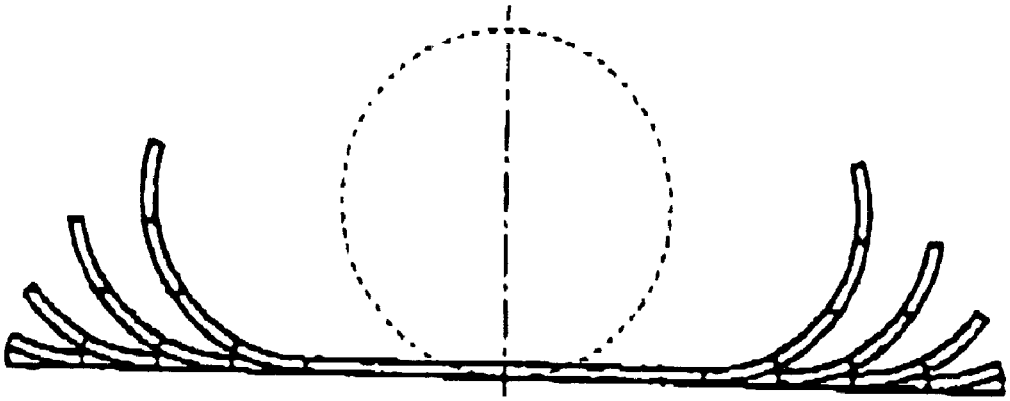
FIG. 1A is a drawing to explain the roll-flower at the breakdown forming portion is for the edge-bend method and FIG. 1B is for the circular-bend method.
Figure 1B:
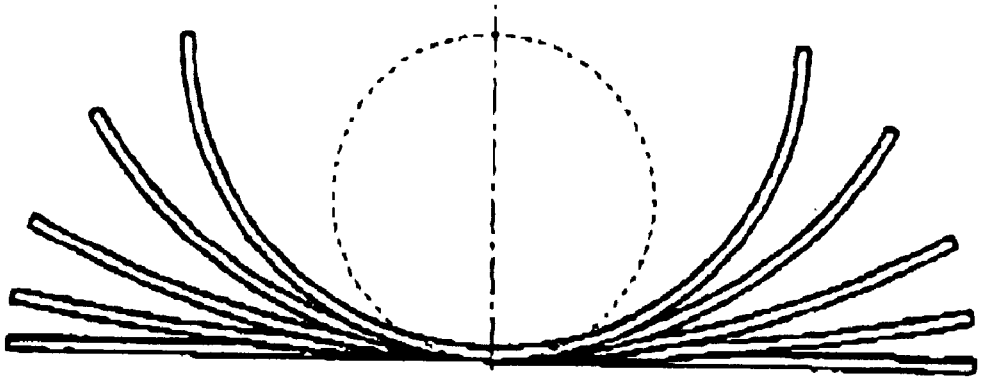
Figure 2A:
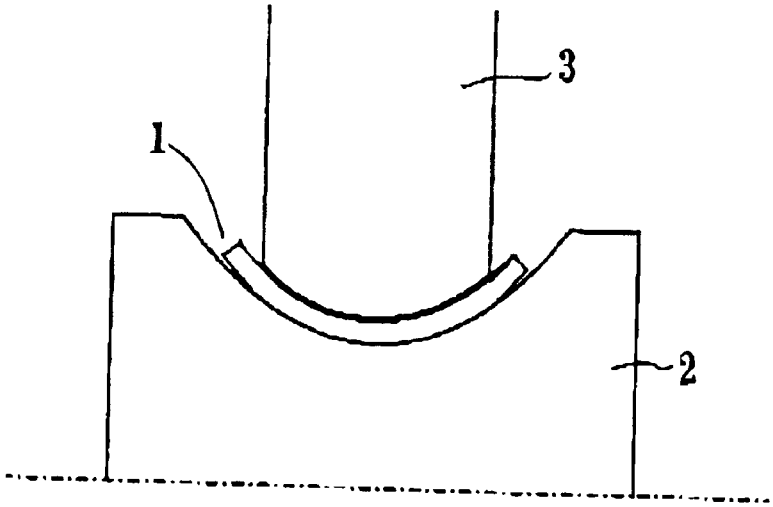
FIG. 2A is an explaining figure of the roll arrangement of the conventional type of breakdown forming stands for a pair of upper and lower rolls.
Figure 2B:
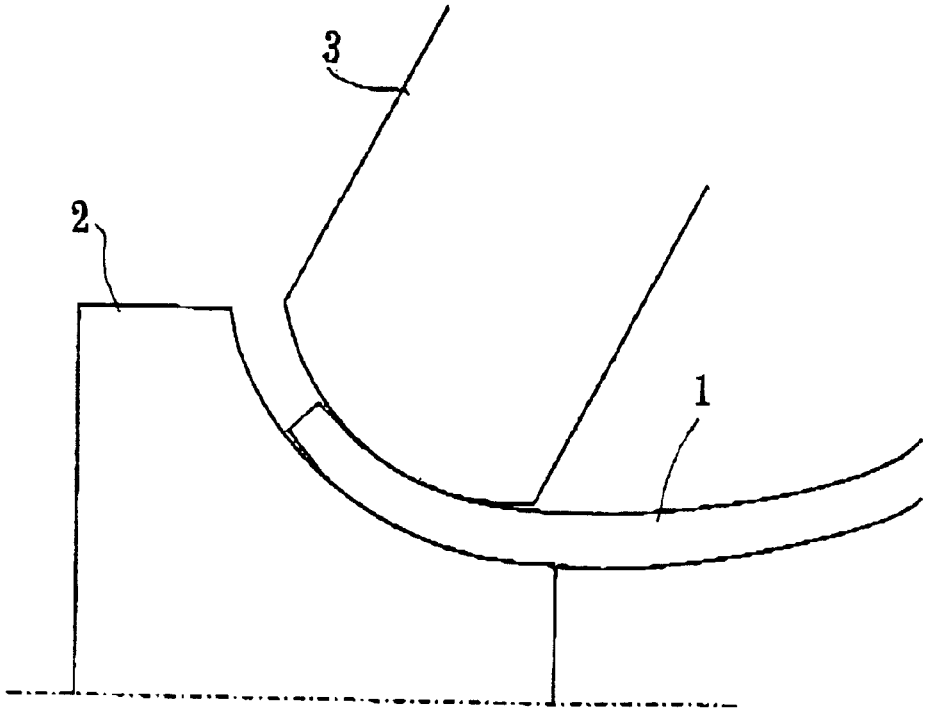
FIG. 2B is of the rolls for the FF forming method.
Figure 4A:
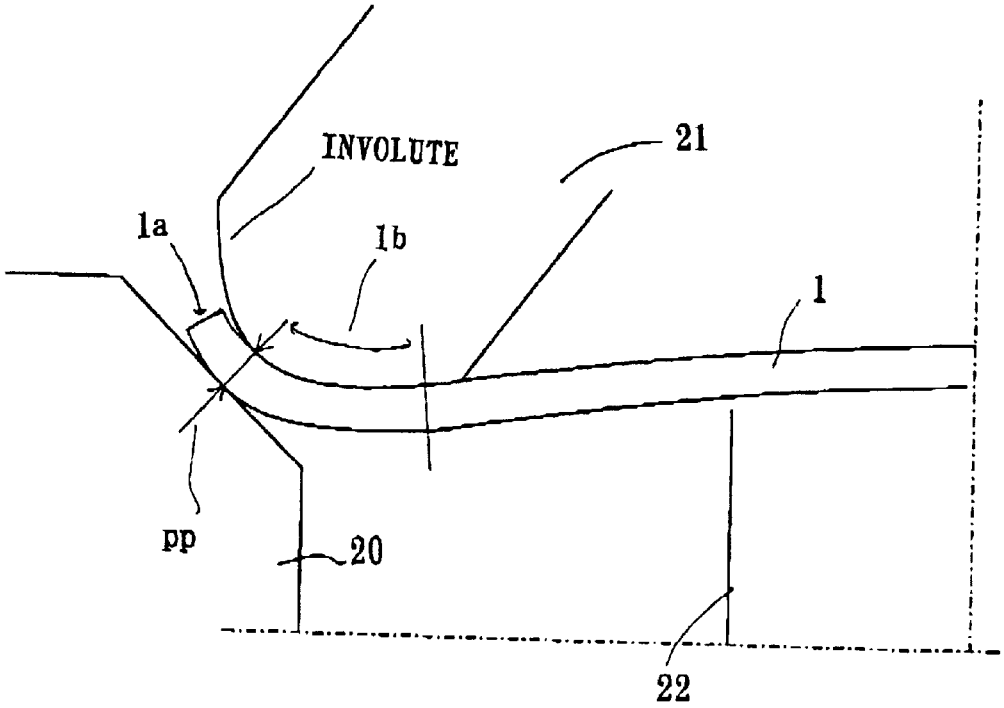
FIGS. 4A and 4B show the roll arrangements in which the "embrace-bending" concept of the present invention is applied to the breakdown forming stands.

As seen in FIG. 4, the roll arrangements at the breakdown forming stand of FIG. 2B is modified in order to perform the "embrace-bending" method of the present invention. First, as seen in FIG. 4A, the pinch-point, pp, is provided at a place apart from the plate edge with a certain distance. The area from the pinch-point, pp, to the plate edge is called as the bending non-sensitive portion 1*a* since the sufficient bending moment is not normally obtained.

Although the range of the bending non-sensitive portion 1*a* depends upon the product's dimensions and material type, it can be defined as to be almost same as the plate thickness. The bending non-sensitive portion 1*a* being located on the outer side of the pinch-point, pp, is supported by the lower roll 20, and the target forming zone 1*b* located on its inner side is wound around the upper roll surface 21 in order to be bent.

Therefore, the pinch-point, pp, is set between the bending non-sensitive portion 1*a* and the target forming zone 1*b*. The contacting surface of the lower roll 20 has a flat surface in order to avoid constraining the target forming zone from the bend-outer side.

In order to correspond to various diameters, it is necessary to adjust the positions of upper and lower rolls. Besides, it is required to select a portion of the upper roll surface with an appropriate curvature distribution to contact the target forming zone, since the degree of forming is mainly controlled by the roll caliber of the upper roll 21.

When the range of the common-utilization of rolls for products' outer diameter is relatively wide, similarly to the FF forming method, it is preferable to provide an involute caliber at the upper roll 21 and use the supporting mechanism with which the supporting axial direction of the roll can be freely changeable in order to not only paralle-move but also rotate the roll, so that an appropriate portion of caliber can be selected to contact the target forming zone.

It is not necessary to provide the involute caliber to the lower roll 20, as has been described previously. If the roller flower is properly designed, it is possible to correspond to forming operation of various pipe sizes even with the linear caliber as seen in FIG. 4A.

If the occurrences of roll-marks or roll-flaws are suspected because of the type of material or wall thickness-diameter ratio, t/D, the involute caliber may also be provided to the lower roll 20, so that the material edge portion can be supported by the roll surface portion having the curvature close to that of the product.

On the other hand, although the embrace-bending does not essentially require to provide the central roll 22 and to form the W-shape cross-section of the material, it possesses a beneficial effect to widen the range of the target forming zone. The shape of the central roll 22 and its position can be set in such a manner that, for forming all different sizes of products, the expected target forming zone should be certainly wound around the upper roll 21.

The roll arrangement seen in FIG. 4A is very effective to bend the edge portion, and is also applicable to bend other portions of material. However, when the range of the common-utilization of rolls is wide, while providing the pre-determined curvature distribution to the target forming zone, it is also necessary to support the previously-formed zone to prevent the bending-back phenomena.

Figure 5A:
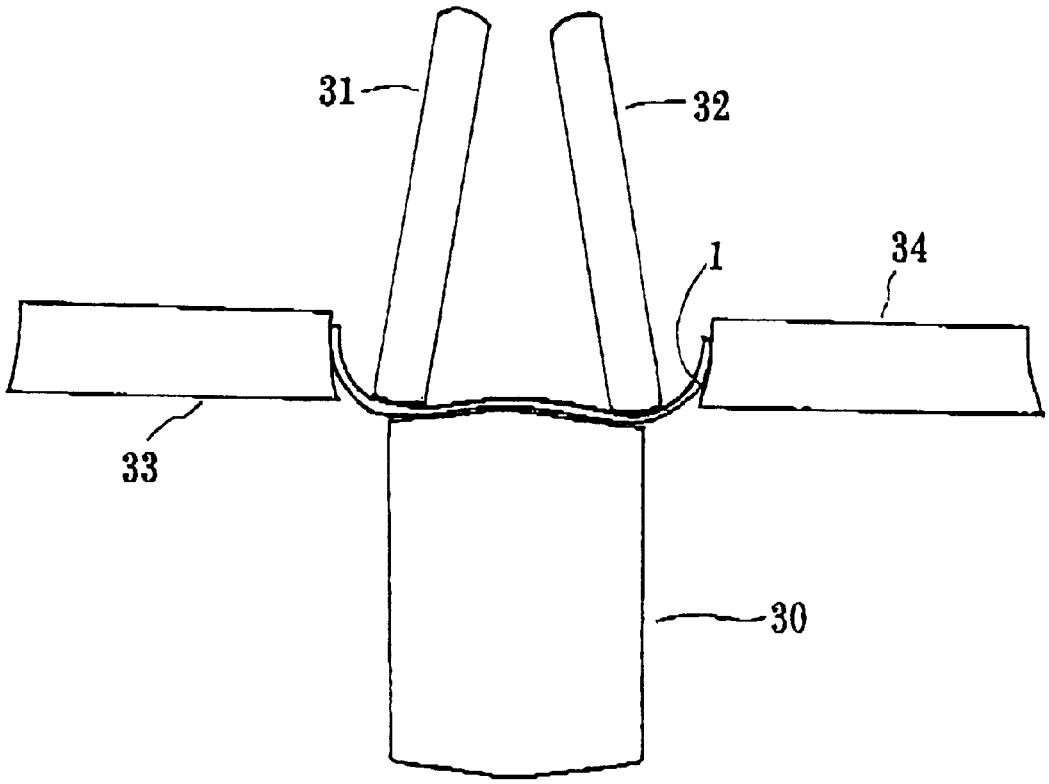

Hence, the roll arrangement as seen in FIG. 5A is extremely effective to form target forming zones except the formed edge portion. With the roll arrangement, although the central roll 30 is provided as similarly as the case in FIG. 4A, it is used not only to improve the embrace-bending efficiency, but also to form the pinch-points, pp, by combining with a pair of upper rolls 31,32 to generate the driving force.

Figure 4B:
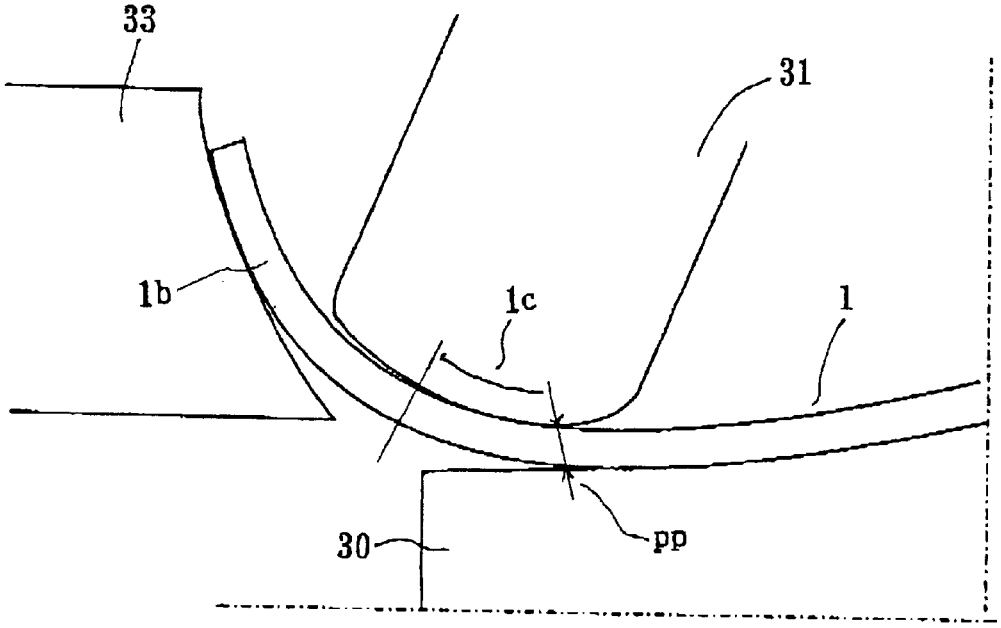

Furthermore, with the roll arrangements seen in FIGS. 5A and 4B, different from that in FIG. 4A, side rolls 33,34 are provided. The side rolls 33,34 are in contact with the above mentioned previously-formed zone in order to prevent the bending-back phenomenon. At the same time, by using the bending moment caused by the forming force from the side rolls 33,34, the target forming zone 1*c* located at the outer side of the pinch-point, pp is wound around the upper rolls 31,32 efficiently.

On the other hand, as seen in FIG. 4B, the bending moment acting on the previously-formed zone 1*b* is small; namely the arm for the bending moment is short because the operating point of the side rolls is within the previously-formed zone; so that this zone is not subjected to a large deformation.

Even if the small size of rolls instead of side rolls 33,34 can be employed to prevent the previously-formed zone from bending-back, so that it is possible to arrange a plurality of small rolls along the longitudinal direction of the material in the above roll arrangement.

Since the control of the curvature distribution of the target forming zone is achieved by the upper rolls 31,32 even with the above mentioned roll arrangements, it is preferable to use the involute caliber to these rolls 31,32 and rotate and/or parallel-move these rolls 31,32 along the width direction of the material to select the caliber portion to contact the target forming zone of the material.

Figure 3:
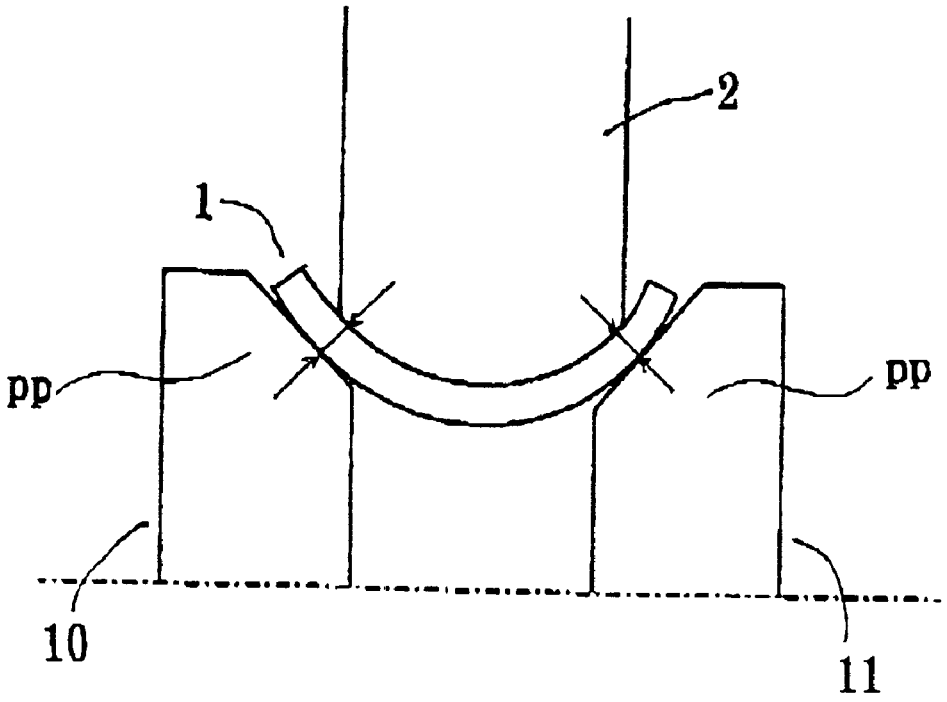
FIG. 3 is a figure of the roll arrangement to explain the "embrace-bending" concept of the present invention.
Figure 5B:
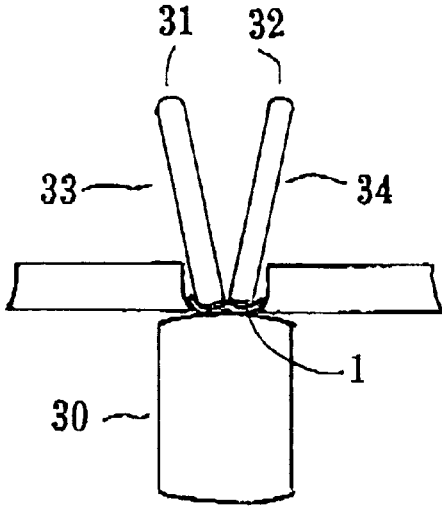
FIG. 5B is for the case of forming the small diameter pipe.

For the side rolls 33,34, as same as the lower rolls 10,11 in FIG. 3, they are needed to make at least the parallel-movement in order to correspond to the forming of various product sizes. Moreover, it is preferable to provide appropriate type of involute caliber in order to prevent the occurrences of roll-flaws or roll-marks to the utmost. FIG. 5A shows the roll arrangement for the case when pipes with relatively large diameter are formed; while FIG. 5B shows the roll arrangement for the case when the pipes with relatively small diameter are formed.

The similar description can be made for the central rolls. It is preferable to employ the separate-type rolls such as two-part-type or three-part-type rolls, which is better than to have a single roll as seen in the figure. It will become more easy to make the target forming zone of the material attach to a certain portion of the caliber of the upper roll by appropriately selecting the position of central roll in width or vertical direction.

On the other hand, at the breakdown forming stands, especially at the forming stand where edge-bending is performed, the forming rolls suffer from the wear damage due to large forming load. Moreover, it is known that edge stretch, which is the main cause of the edge wave, is apt to take place at these stands.

Roll wear and edge wave mentioned above may occur even when using the embrace-bending method of the present invention. However, the present inventors have discovered that, small-size auxiliary rolls being in contact to the edge of the material can be mounted at vicinity of the upper and/or lower stream of the breakdown forming stands, so that some of the forming load will be allotted to the auxiliary roll, resulting in that the forming load and surface pressure which are acting on the lower roll will be reduced.

Figure 6A:
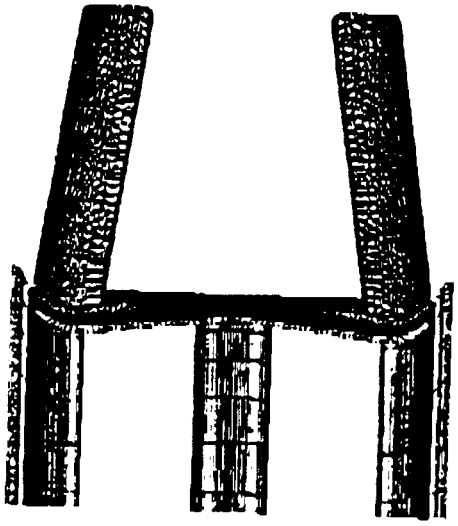
FIGS. 6A, 6B, and 6C show the roll forming method and roll arrangements of the roll stands for the breakdown forming portion as one of the embodiment of the present invention.

By referring to drawings, the auxiliary roll will be described in details as follows. As seen clearly from FIGS. 6A and 6B, the edge portion of the material 1 will be gradually rising while approaching to the center of the upper roll 40 or lower roll 41 at the breakdown forming stand. At an early stage of the contacting process, only the sharp outer edge corner of the material will be in contact to the lower roll surface 40.

Figure 7A:
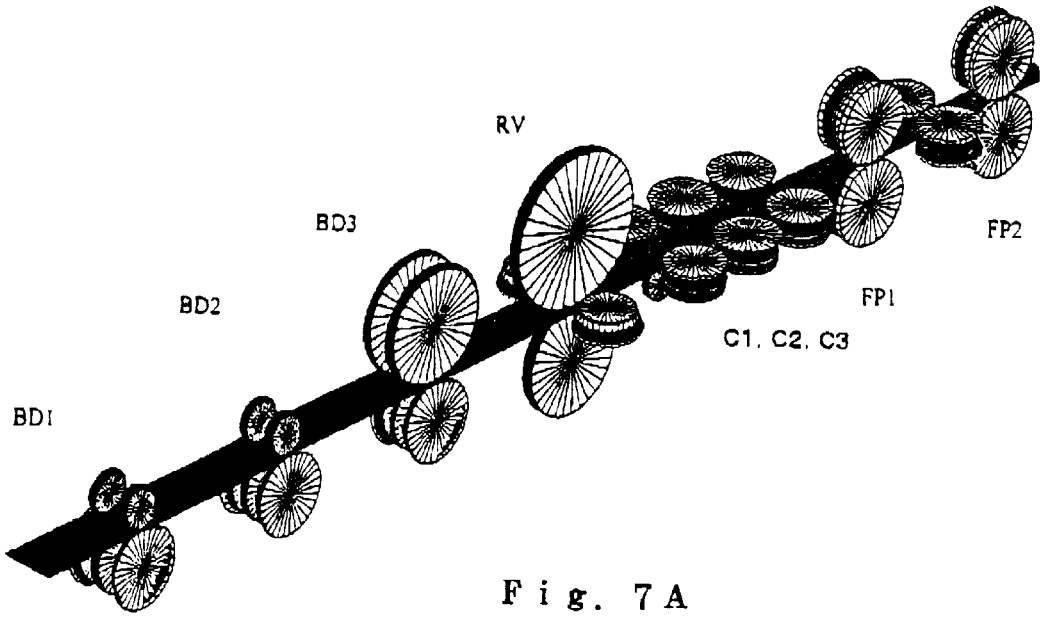
FIG. 7A shows a perspective view of roll arrangement of the pipe mill when the roll forming method and its equipment of the present invention are applied; while 7B is a figure to explain the roll arrangement of the reverse-bend forming portion; and 7C is a figure to explain the roll arrangement of the cluster forming portion.

At this stage, since the contact is almost the point contact, roll wear could take place easily due to the abnormally high surface pressure. In order to avoid this abnormal roll wear, as seen in FIG. 7A, a pair of small-size non-driven type second auxiliary rolls 53,55 is mounted at a vicinity of the upper and lower stream close to the lower rolls 50,51 to attach to the outer edge corner of the material 1, so that the edge portion of the material 1 can be supported.

When the auxiliary rolls 53,54 are provided at the upper stream as described in the above, the outer edge corner of the material will become in contact to the auxiliary rolls 53,54 before contacting to the forming rolls 50,51. In such a case, when the material is moving towards forming rolls 50,51, the edge portion of the material has already been raised to some extent. After contacting to the lower rolls 50,51, the contact area increases rapidly, so that the abnormally high surface pressure can be prevented.

Moreover, the contact with the auxiliary rolls 53,54 dulls the outer edge corner of the material and reduces the possibility of occurrence of the abnormally high surface pressure. Furthermore, by mounting the second auxiliary rolls 53,54, some of the forming load will be allotted to the auxiliary rolls 53,54 and the forming load and surface pressure acting on the lower rolls 50,51 can be reduced.

When the auxiliary roll 53 is provided at only the upper stream, it is preferable to constrain firmly the material along the longitudinal direction by mounting the auxiliary roll 55 at the lower stream side of the forming stand since the steel band will rotate along the longitudinal direction around the upper roll 52 as a supporting point and the effect of the auxiliary roll 53 will be reduced if there is no auxiliary roll mounted at the lower stream side of the forming stand.

In the present invention, the wear problem of the auxiliary roll can not be avoided. However, since the auxiliary roll according to the present invention is a small-size non-driven type, roll per se as well as its supporting mechanism can be very simple compared with the forming rolls, so that the equipment and maintenance cost will be low and exchanging operation for polishing these roll surfaces will also be easier and simpler.

Moreover, since the essential function of the second auxiliary roll is to support the edge of the material and it only contacts the edge corner of the material, formability and product quality will not adversely been affected even if they are worn. For such a case, it is not required to exchange and polish these auxiliary rolls.

The above mentioned auxiliary roll not only controls the wear phenomenon of the forming roll, but also exhibits a great effect to prevent the so-called edge wave of the material caused by the excessive edge stretch during the forming process. The occurrence of the edge stretch is the most remarkable at the breakdown forming area.

It is normally believed that the evidence—that spatial transferring distance at the width edge portion of the material is longer than that at other portions due to the spring-back between the stands—is a main reason to cause the edge stretch. However, according to what the present inventors have observed through extensive experiments and analyses, it has been found that the effect of the spring-back on the differences in the spatial locus is not large, rather the edge wave takes place mainly due to the fact that the edge portion is locally stretched when it rises along the roll surface.

Figure 6B:
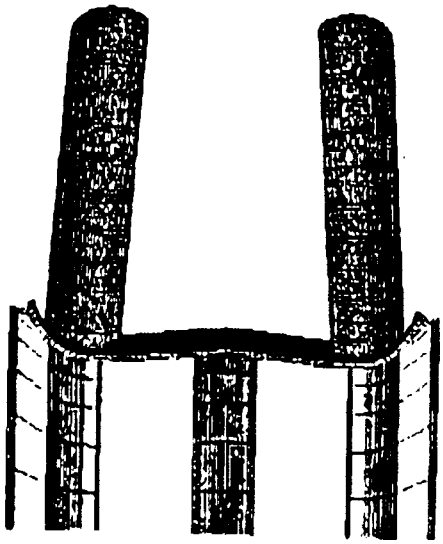
Figure 6C:
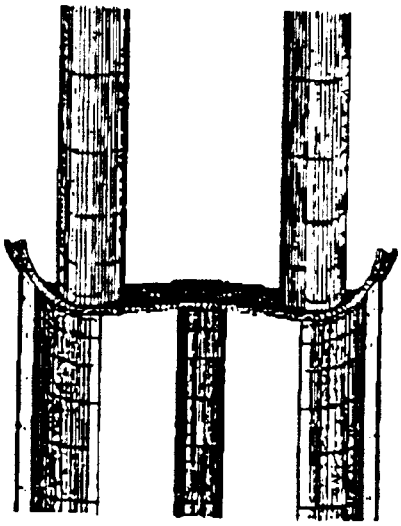

As seen in FIG. 6B, when the material 1 is entering the roll gap, the edge portion winds around the surface of lower roll 40 and rises. Since, during this short period of time, the S-shaped spatial locus 42 created by the edge portion is much longer than nearly-liner loci created by other portions, a large amount of edge stretch will take place. Moreover, due to such an edge stretch, downward-warp will occur on the longitudinal direction of the material after the material passes through the roll gap, causing the same rising problem at the subsequent stand.

In order to solve the problem, it can be done to set the height of the edge portion prior to entering the roll gap to the same level of the edge portion in roll gap or slightly higher than that in order to make the locus of the edge portion to close to be linear as possible.

However, even if the pass-line 44 is set as described in the above, since the height of other portions of the material goes down due to the constraint of rolls 40,41, the edge portion will leave from the pre-set pass-line 44 and continuously goes down until the position where it balances with the locus 46 of other portions. Then, the locus 45 of the edge portion will rise along the lower roll surface 40. As a result, the effect of reducing the rising of the edge portion by setting the pass-line 44 is very small.

As clearly understood from the aforementioned analyses, it is found that before entering the roll gap, the rigidity itself of the material's edge portion can not keep the pre-set pass-line. However, the mounting the second auxiliary roll as seen in FIG. 11 can solve this problem.

According to the present invention, since the auxiliary roll does not contribute directly to the forming of the products, it is not required to design the roll caliber with respect to the products' dimension as done for the forming rolls. The flat rolls can be used if the edge corner of the material can be supported at the desired position. Furthermore, the auxiliary roll requires only a simple supporting device being mounted before and after the forming stand, so that the exclusive stand just for the auxiliary roll is not needed.

Figure 7B:
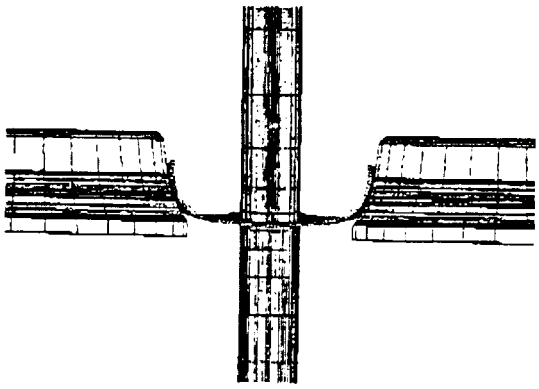
Figure 7C:
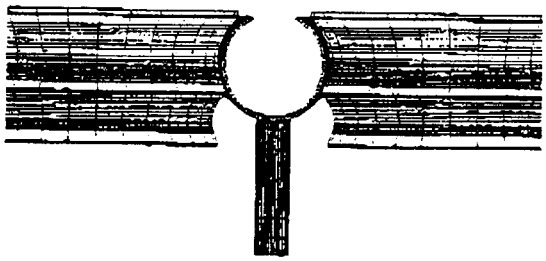

In the present invention, since the shorter the distance (pitch) from the supporting point of the material's edge corner to center of the lower roll, the larger various effects obtained from the auxiliary rolls, the shorter distance (pitch) can be obtained if the auxiliary roll is placed at the same stand as the lower roll. Moreover, in order to obtain the short pitch, as seen in FIG. 7B, it is extremely effective to decline the axis of the auxiliary roll toward the center of the lower roll along the longitudinal direction.

When the size of the product changes and the same auxiliary roll does not correspond to this changes, it is obviously necessary to exchange rolls. However the common-utilization of the auxiliary rolls can be achieved if the roll flowers are designed in such a way that the positions of the edge corners are on a certain curve.

EMBODIMENTS

Embodiment 1

By referring to FIGS. 8 and 9, embodiment of applying the roll forming method and equipment of the present invention to the roll arrangements No. 1 through 3 in the break-down forming portion in the pipe mill system of FF/X forming method, which the present inventors have previously proposed, will be described. In such a pipe mill system, as clearly seen in FIG. 9A, roll stands BD1, BD2, BD3 at the breakdown forming portion are arranged, followed by roll stand RB at the reverse-bend portion, cluster roll C1 through C6 in the cluster forming portion, and roll stands FP1, FP2 at the fin-pass forming portion.

Figure 8A:
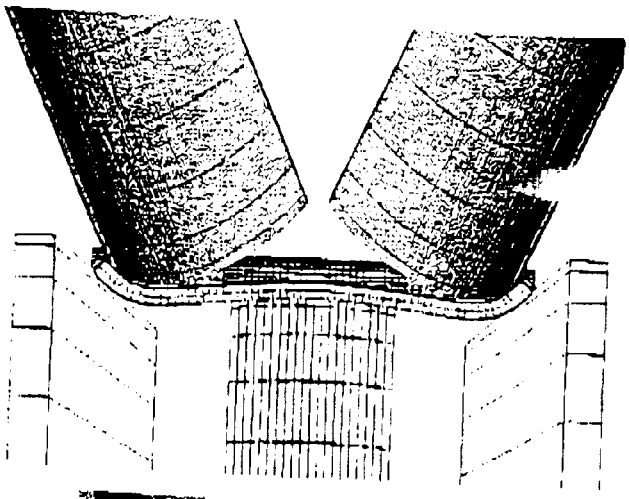
FIGS. 8A, 8B, and 8C show the roll arrangement of the roll stand for the breakdown forming portion as another embodiment when the roll forming method and equipment of the present invention are applied.
Figure 9A:
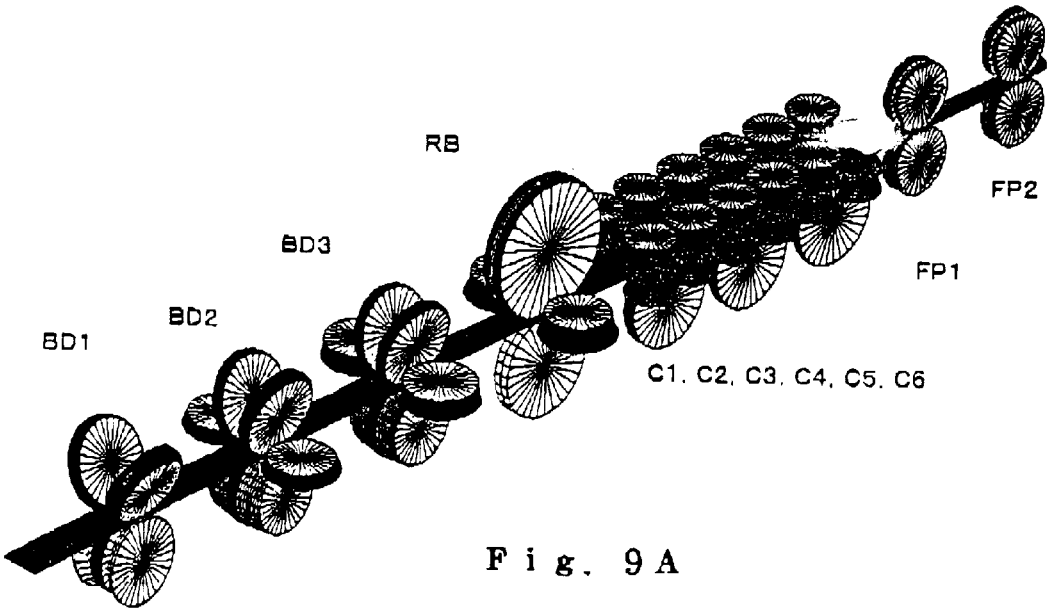
FIG. 9A is a perspective view of the roll arrangement of the another pipe mill when the roll forming method and equipment of the present invention is applied; while 9B is a figure to explain the roll arrangement of the reverse-bend forming portion and 9C is a figure to explain the roll arrangement for the cluster forming portion.

At the roll stand BD1 of the break-down forming portion, as seen in FIG. 8A, a rotation-type pair of left and right upper rolls which is changeable to the contacting direction against the material and a pair of left and right lower roll together with the central roll having a narrow width are mounted. Between such upper and lower rolls, the pinch-point is set at the boundary area between the target forming zone along the material's width direction which is ready to form at the BD1 stand and the bending non-sensitive material's edge portion. Such a pinch-point possesses the same mechanism and function as described in FIG. 4A to perform a certain edge-bending operation.

Figure 8B:
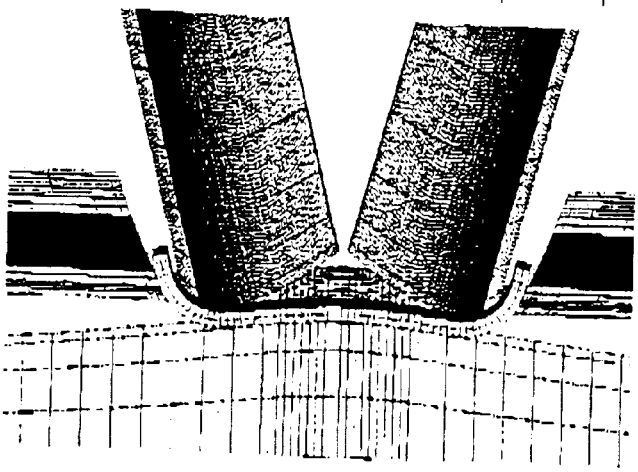
Figure 8C:
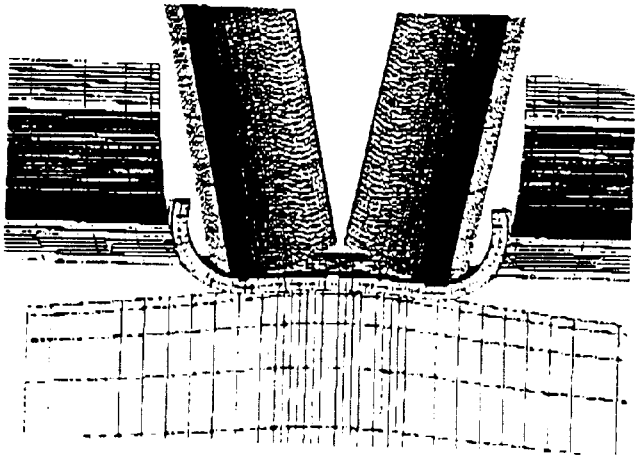

The roll stand BD2 seen in FIG. 8B consists of a rotation-type pair of left and right upper rolls, a wide lower central roll, and a pair of horizontal rolls to support the edge portion of the material which was previously formed at the BD1 roll stand. Between the upper roll and shoulder portion of the central roll, the pinch-point is provided at the boundary area between the target forming zone which is planned to be formed at the stand BD2 and the un-formed zone of the material's central portion, to exhibit the same mechanism and function as described in FIG. 4B to perform the bending operation.

The roll stand BD3 has the same mechanism and function as the previous roll stand BD2 does, and is used to bend a target forming zone which is closer to the center of the material. The portion of material at the outer side of the target forming zone, which has already been formed at previous roll stands BD1 and BD2 is supported by the horizontal roll with an involute caliber, so that the bending-back of the formed portion of the outer side of the target forming zone is prevented.

Figure 9B:
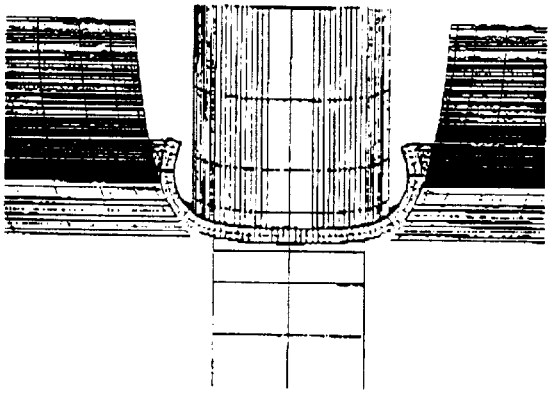
Figure 9C:
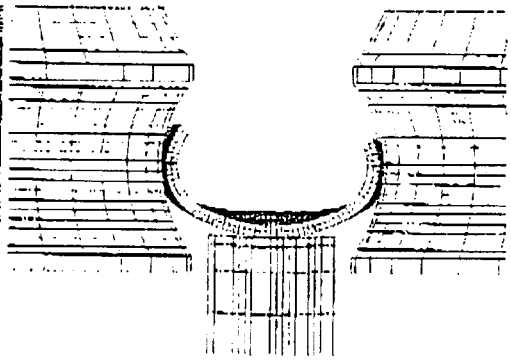

In the next step, the central portion of material which is pushed upwardly by the central rolls at BD1, BD2 and BD3 is reversed at roll stand RB as seen in FIG. 9B. Hence, introducing the material into the cluster forming portion will be much easy. Furthermore, the cross-section of the material will be formed into a profile near an open circle by subsequent fin pass forming portions FP1, FP2.

By employing the pipe mill system as seen in FIG. 9A of the present invention, the edge-bend forming method without exchanging rolls can be realized at the breakdown forming portion, so that formability is extremely improved and the common-utilization of rolls in a range of about three-fold in terms of diameter ratio can be achieved.

Embodiment 2

In the conventional type of the FF forming method, another embodiment of applying the roll forming method and equipment of the present invention to the roll arrangements No. 1 through 3 of the breakdown forming portion will be described by referring to FIGS. 10 and 11. The pipe mill, as seen in FIG. 11A, comprises of roll stands BD1, BD2, BD3 at the breakdown forming portion, roll stand RB of the reverse forming portion, cluster roll stands C1, C2, C3, and roll stands FP1, FP2 in the fin-pass forming portion.

Figure 10A:
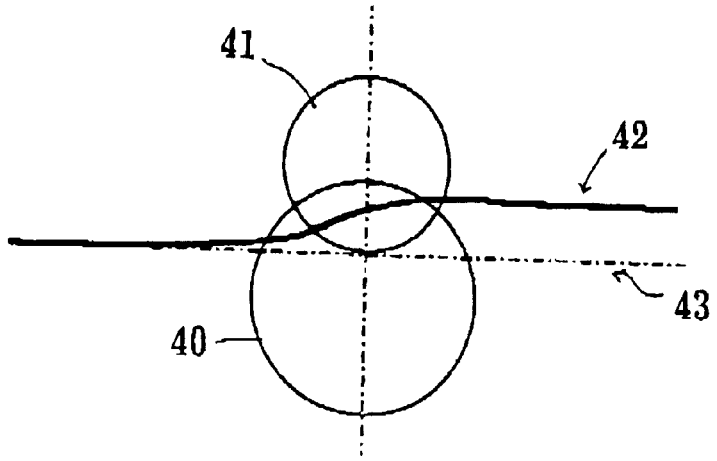
FIG. 10A shows a case when the auxiliary rolls are mounted to the breakdown forming stand from a front view and FIG. 10B shows a side view.
Figure 11A:
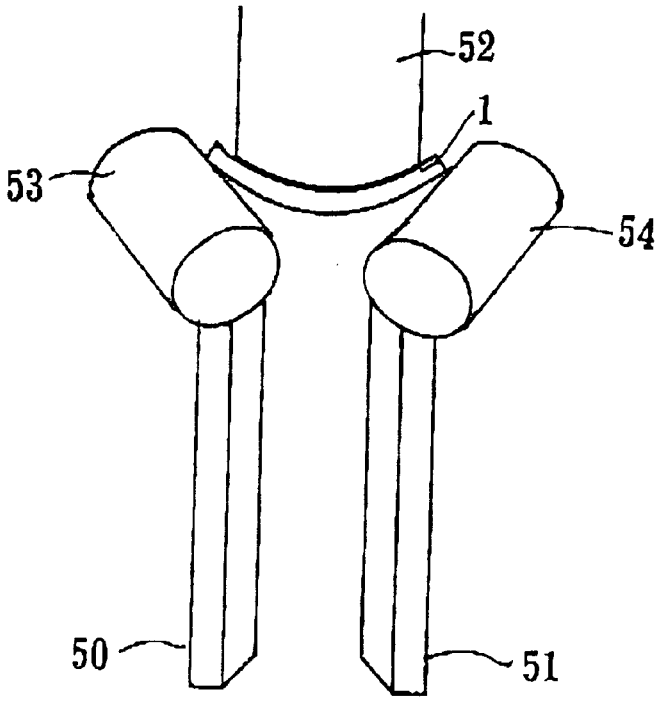

In the roll stand BD1 in the breakdown forming portion, as seen in FIG. 10A, a rotation-type pair of left and right upper rolls which are changeable in the contacting direction with the material, a narrow central roll, and a pair of left and right lower rolls with involute calibers are mounted. Between the upper and lower pairs of rolls, the pinch-point is provided at the boundary area between the target forming zone which is ready to be formed at the roll stand BD1 and the bending non-sensitive zone of the material's edge portion. Such a pinch-point possesses the same mechanism and function as described in the FIG. 4A to perform the edge-bending operation. The target forming zone is not in contact with the roll caliber of the lower roll except its boundary at the pinch-point (not seen in Figure).

Figure 10B:
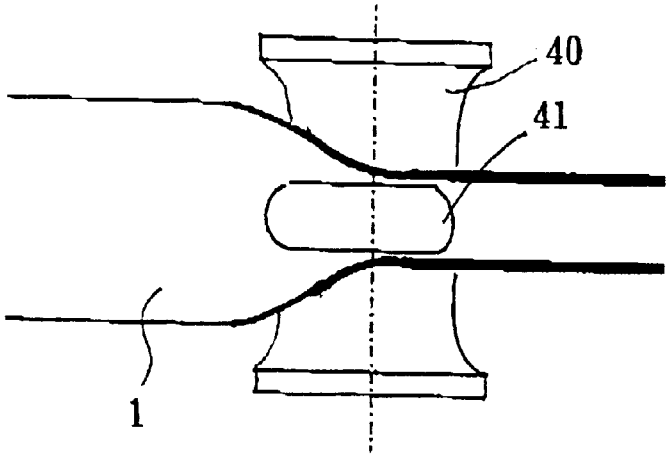

At the roll stand BD2 as seen in FIG. 10B, a rotation-type left and right pair of upper rolls and a pair of left and right lower rolls are provided. Between the upper rolls and lower rolls having involute calibers, the pinch-point is provided at the boundary area between the target forming zone which is ready to be formed at the roll stand BD2 and the previously-formed zone formed at the roll stand BD1. Such a pinch-point exhibits same mechanism and function as described in FIG. 4B. Here again, the target forming zone is not in contact with the roll caliber of the lower roll except its boundary at the pinch-point. On the contrary, the material's edge portion which was previously formed at the roll stand BD1 is in contact and supported with the involute caliber of the lower roll to maintain the expected formability.

Figure 10C:
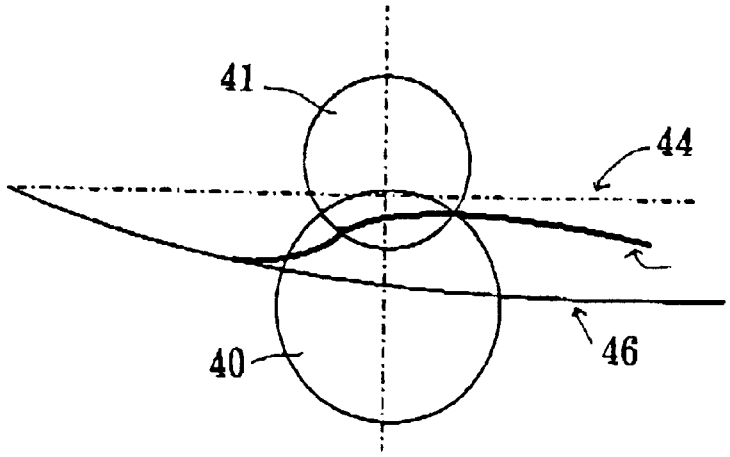

The roll stand BD3, as seen in FIG. 10C, possesses the same mechanism and function as previous roll stand BD2 does. At this stand, a target forming zone which is closer to the central of the material is bent. The material's edge portion which was already formed by previous roll stands BD1 and BD2 is supported along the involute caliber of the lower roll, so that the bending-back of the formed portion is avoided.

Figure 11B:
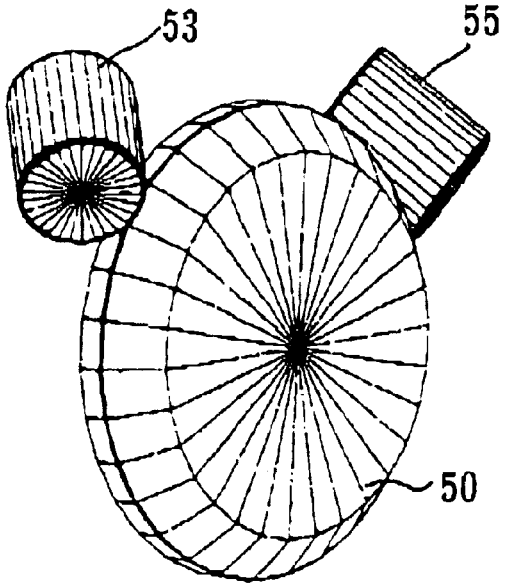

In the next step, the central portion pushed upwardly by central rolls at BD1, BD2 and BD3 is reversed at the roll stand RB as seen in FIG. 11B. Hence, introducing the material into the cluster forming portion will be much easy, as seen clearly in FIG. 11C. Furthermore, the cross-section of the material will be formed into a profile near an open circle by subsequent fin pass forming portions FP1,FP2.

By employing the pipe mill system as seen in FIG. 11A of the present invention, the edge-bend method without exchanging rolls can be realized at the breakdown forming portion, so that formability is extremely improved and the common-use of rolls in a range of about 2.5-fold in terms of diameter ratio can be achieved.

Embodiment 3

Using the pipe mill system for the welded steel pipes which employs three units of forming stands to the breakdown forming portion according to the FF/X forming method, the auxiliary rolls are provided with an attachable manner before and after the breakdown forming portion. The edge stretch of the steel plate was measured at each stand at the breakdown forming portion. Table 1 shows the results for three cases; namely they include (1) without any auxiliary roll, (2) auxiliary rolls before and after the roll stand BD1, and (3) auxiliary rolls before and after roll stands BD1 and BD2.

In the case when the auxiliary roll is not mounted, a large edge stretching was observed at roll stands BD1 and BD2. On the other hand, in the case when the auxiliary rolls were mounted before and after the roll stand BD1, although the edge stretching can not be eliminated completely, the value of the edge stretching recorded was less than half at the BD1 and about one quarter at BD2.

Moreover, when the auxiliary rolls were also provided before and after the roll stand BD2 to support the edge portion of the steel plate, the edge stretching at stand BD2 was furthermore reduced down to another half. From this result, it is clearly understood that the auxiliary roll possesses very effective function to prevent the edge stretch.

Furthermore, Table 2 shows the results of effects of the auxiliary roll on the thrust and forming load at the roll stand BD2. From results presented in Table 2, it is obvious that the thrust on the BD2 roll stand and forming load acting on the lower roll are clearly different between the case when the auxiliary roll is not provided before and after the roll stand BD1 and the case when the auxiliary roll is provided before and after the roll stand BD1.

Namely, the introducing of the material into roll gap can be greatly improved due to the fact that the edge rising is remarkably reduced due to the effects of the auxiliary roll. Moreover, the effect on the thrust and forming load is very significant.

TABLE 1

| | without auxiliary roll | auxiliary roll before & after BD1 | auxiliary roll before & after BD1,2 |
|---|---|---|---|
| BD1 stand | 2.25% | 1.1% | 1.1% |
| BD2 stand | 1.8% | 0.48% | 0.25% |
| BD3 stand | 0.5% | 0.48% | 0.48% |

TABLE 2

| when the auxiliary roll is not provided before and after BD1 stand | | when the auxiliary roll is provided before and after BD1 stand | |
|---|---|---|---|
| forming load acting on the lower roll of BD2 stand | thrust at BD2 stand | forming load acting on the lower roll of BD2 stand | thrust at BD2 stand |
| 6,530 kg | −10 kg | 2,750 kg | 180 kg |

According to the present invention, the pinch-point formed by the upper and lower rolls is set at the boundary area between the target forming zone along the material's width direction and previously-formed zone or un-formed zone. The target forming zone is wound around a certain caliber of the upper roll being positioned at the bend-inner side, and bend-formed in such a manner that the lower roll is in almost no-contact condition with the target forming zone. As a result, the bending formability can be greatly improved, and roll flaws and roll-marks can be prevented.

According to the roll forming method of the present invention, the concave roll does not contribute directly to control the curvature distribution of the target forming zone. On the other hand, the target forming zone is basically constrained only by the convex roll, so that the excess deformation hardly take place and the occurrence of the superfluous deformation strain can be prevented.

Moreover, when the roll is driven, the maximum surface pressure is generated on the pinch-point. Since the roll diameter corresponding to this pinch-point is used as a roll reference diameter and the position of the pinch-point is clearly identified and not changed, the driving force among each roll stand can be synchronized easy.

Furthermore, in the roll forming method of the present invention, the contacting condition between the material and rolls is stable regardless of variations in wall thickness of the material, so that the twist phenomena is not induced.

According to the roll forming method of the present invention, since it is not necessary that both concave and convex rolls are rolls with exclusive roll caliber corresponding to the product to be formed, the common-utilization rolls is easy to realize. Also, the forming function and operativity of mill can be greatly improved by introducing it to the breakdown forming portion.

Furthermore, by providing the auxiliary roll at the area in vicinity of upper stream and lower stream of the lower roll of the breakdown forming stand to support the edge of the material to the pre-set height, the forming load and surface pressure acting on the lower roll can be reduced. As a result, the local wear on the roll can be reduced. Also forming defects such as the edge wave caused by the localized stretching of the edge portion can be eliminated.

While this invention has been described with respect to preferred embodiments and examples, it should be understood that the present invention is not limited to those embodiments and examples; rather many modifications and variations would present themselves to those of skill in the art without departing from the scope and spirit of the present invention, as defined in the appended claims.

What is claimed is:

1. A method of roll forming a material having a bend-inner side and a bend-outer side comprising the steps of forming a pinch-point using at least one pair of upper and lower rolls setting the pinch-point at a boundary area between a target forming zone of the material along a width direction of the material and either one of a previously-formed zone and an un-formed zone of the material, and winding an entire body of a target forming zone of the material around a roll surface on the bend-inner side without being constrained from the bend-outer side.

2. The method of roll forming according to claim 1 further comprising the step of contacting side rolls with the previously-formed zones of the material from the bend-outer side wherein bending-back phenomena is prevented.

3. The method of roll forming according to claim 1 further comprising the step of pushing a central portion of the material along a width direction from the bend-outer side through a contacting roll wherein a W-shaped cross-section is formed.

4. The method of roll forming according to claim 1 further comprising the step of shaping a roll caliber with a plurality of arcs.

5. The method of roll forming according to claim 4 wherein welded steel pipes are used in a breakdown forming portion of the roll forming method.

6. The method of roll forming according to claim 1, comprising the further steps of contact mounting an auxiliary roll with an edge of the material at a vicinity of upper and lower streams of forming rolls in forming stands, and using the auxiliary roll to support an edge of the material to a predetermined height.

7. The method of roll forming according to claim 4 comprising the step of using an involute as the roll caliber.

* * * * *